US010722916B2

(12) United States Patent
Demeris, Jr.

(10) Patent No.: US 10,722,916 B2
(45) Date of Patent: Jul. 28, 2020

(54) CAULK GUN ATTACHMENT FOR WIPING EXCESS CAULK

(71) Applicant: Caulk Garbage Can LLC, Lombard, IL (US)

(72) Inventor: William A. Demeris, Jr., Lombard, IL (US)

(73) Assignee: Caulk Garbage Can LLC, Lombard, IL (US)

( * ) Notice: Subject to any disclaimer, the term of this patent is extended or adjusted under 35 U.S.C. 154(b) by 0 days.

(21) Appl. No.: 15/922,463

(22) Filed: Mar. 15, 2018

(65) Prior Publication Data

US 2019/0224711 A1 Jul. 25, 2019

Related U.S. Application Data

(60) Provisional application No. 62/619,504, filed on Jan. 19, 2018.

(51) Int. Cl.

| | |
|---|---|
| ***B05C 21/00*** | (2006.01) |
| ***B05C 17/01*** | (2006.01) |
| ***B05C 17/005*** | (2006.01) |
| ***E04F 21/00*** | (2006.01) |

(52) U.S. Cl.

CPC ..... *B05C 21/00* (2013.01); *B05C 17/0052* (2013.01); *B05C 17/01* (2013.01); *E04F 21/00* (2013.01)

(58) Field of Classification Search

CPC combination set(s) only.

See application file for complete search history.

(56) References Cited

U.S. PATENT DOCUMENTS

| | | | | |
|---|---|---|---|---|
| 2,951,619 | A | 9/1960 | Strumor | |
| 3,401,847 | A | 9/1968 | Downing | |
| 3,481,510 | A | 12/1969 | Allen | |
| 3,754,831 | A | 8/1973 | Hutter | |
| 5,413,258 | A * | 5/1995 | Kartler | B05C 17/00516 222/575 |
| D409,381 | S * | 5/1999 | Cleveland | B05C 17/00516 D3/228 |
| 6,067,683 | A * | 5/2000 | Reeves | B05C 21/00 15/105 |
| 6,325,261 | B1 * | 12/2001 | Webber | B05C 17/01 224/251 |
| 6,474,519 | B1 * | 11/2002 | Cleveland | A45F 5/02 224/251 |
| 6,491,191 | B1 * | 12/2002 | Cleveland | A45F 5/00 224/251 |
| 7,712,635 | B2 | 5/2010 | Kovac | |
| 7,823,753 | B2 | 11/2010 | Kovac | |
| 8,701,237 | B2 | 4/2014 | Brosche | |
| 8,991,662 | B2 | 3/2015 | Milan | |

(Continued)

*Primary Examiner* — Patrick M. Buechner

(74) *Attorney, Agent, or Firm* — Erickson Law Group, PC

(57) ABSTRACT

A caulk wiping attachment for a caulk gun includes a tube having at least one open end for providing a circular wiping edge. The tube can be attached directly to a barrel of the caulk gun or to a disposable caulk cartridge installed into the barrel of the caulk gun. The tube can be cylindrical with an annular cross section. The tube can be attached to the caulk cartridge using a sleeve slipped over the caulk cartridge, the tube being attached to an outside of the sleeve. A disposable liner or cup can be held within the tube.

9 Claims, 6 Drawing Sheets

(56) References Cited

U.S. PATENT DOCUMENTS

| | | | | |
|---|---|---|---|---|
| 9,027,796 | B1 * | 5/2015 | Leitch | B05C 17/01 15/105 |
| 2004/0144804 | A1 | 7/2004 | Borisch | |
| 2006/0283891 | A1 * | 12/2006 | Kovac | B05C 17/01 222/327 |
| 2013/0134182 | A1 * | 5/2013 | Brosche | B05C 17/0052 222/1 |
| 2016/0045930 | A1 | 2/2016 | Hoover | |

* cited by examiner

CAULK GUN ATTACHMENT FOR WIPING EXCESS CAULK

This application claims the benefit of U.S. Provisional Application Ser. No. 62/619,504, filed Jan. 19, 2018.

BACKGROUND

In construction, remodeling and repair, it is known to use a caulk gun with a replaceable caulk cartridge or tube to seal seams, cracks and other surface formations. During caulking it is a common experience that after a bead of caulk is dispensed from the caulk cartridge, a user smooths the bead with a smoothing tool or the user's finger. During the caulking procedure, the smoothing tool or the user's finger can collect excess caulk thereon which needs to be wiped to continue caulking in a neat fashion without accidentally fouling the work surface or the user with wiped-off caulk.

In this regard it has been known to provide some articles which provide a surface to wipe caulk from the user's finger or tool.

U.S. Pat. No. 6,067,683 discloses a caulking gun apparatus for a user to clean caulk from the user's finger. The apparatus includes a receptacle defining an upper edge and a finger-receiving cut-out portion defined within the edge. Clips are connected to the receptacle for removably holding the apparatus in fixed position on the gun. The user can wipe his finger across the cut-out portion to remove caulk from the user's finger and collect the removed caulk within the receptacle.

U.S. Pat. No. 8,701,237 discloses an apparatus for removing caulk from a user's finger. The apparatus is used with a disposable tube-style caulk cartridge and caulking guns. The apparatus includes an upper edge with finger receiving notches for removing caulk from a user's finger, and a component for collecting the removed caulk.

U.S. Pat. No. 9,027,796 discloses a tool for use with a conventional caulking gun, aiding the user in finishing after the caulking material has been applied. One function of the tool is to collect excess caulk from the user's finger. The caulking apparatus "piggy-backs" onto a disposable cartridge or fill material style caulking gun.

The present inventor has recognized that there is a need for a caulking gun or cartridge attachment that provided a convenient and effective apparatus for the user to wipe caulk from the worker's finger of from a smoothing tool. The present inventor has recognized that there is a need for such an attachment to be cost-effectively manufactured, to be durable and to be simple in construction.

SUMMARY

The exemplary embodiments of the invention provide a caulk gun attachment that is simple, rugged and cost effectively manufactured. The exemplary embodiments of the invention provide a caulk gun attachment that is easy to use and prevents fouling of work clothes, tools or the work surfaces by excess caulk accumulated on the worker's finger or on a worker's caulk smoothing tool.

One apparatus of the invention provides a tube attached to either the caulk cartridge or to the caulk gun. The tube can have one or two open ends that provides a continuous circular edge for the worker to wipe excess caulk and which then allows the caulk to be positioned inside the tube. Thus, the collection of the excess caulk in the tube is prevented from touching and fouling work clothes, tools or the work surface by being enclosed within the tube. If the caulk gun is dropped or laid on the floor the accumulated caulk in the tube does not foul the floor as it is enclosed in the tube.

According to one embodiment, the tube has a circular cross section, i.e., a cylinder, which is inherently resistant to crushing and is readily and cost effectively manufactured.

Although the embodiments of the invention are suitable for a caulking operation are described herein, it is not limited to this use and other uses, where a wiping of excess material during a dispensing operation is undertaken, are encompassed by the invention.

Numerous other advantages and features of the present invention will become readily apparent from the following detailed description of the invention and the embodiments thereof, from the claims and from the accompanying drawings.

DETAILED DESCRIPTION

Figure 2:
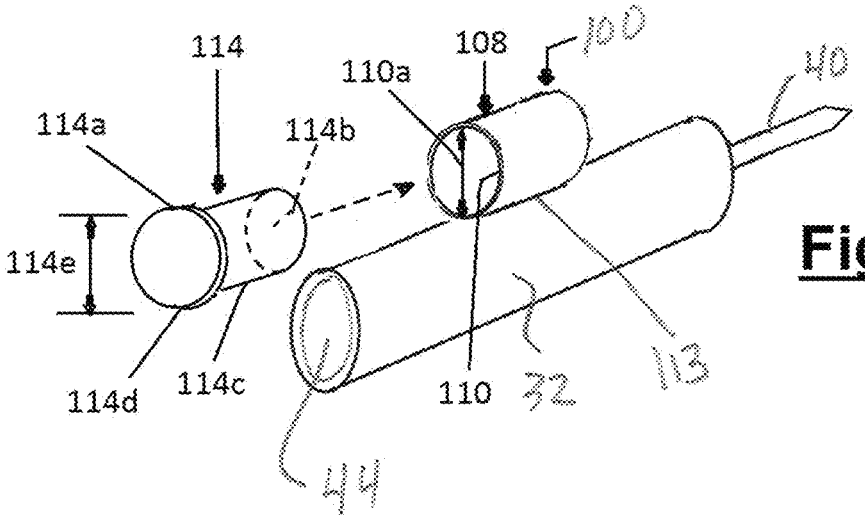
FIG. 2 is a perspective view of a caulk cartridge having an exemplary apparatus of the invention attached to the caulk cartridge.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

This application incorporates U.S. Provisional Application Ser. No. 62/619,504, filed Jan. 19, 2018 by reference.

FIGS. 1-10 describe exemplary embodiments of the invention.

Figure 1:
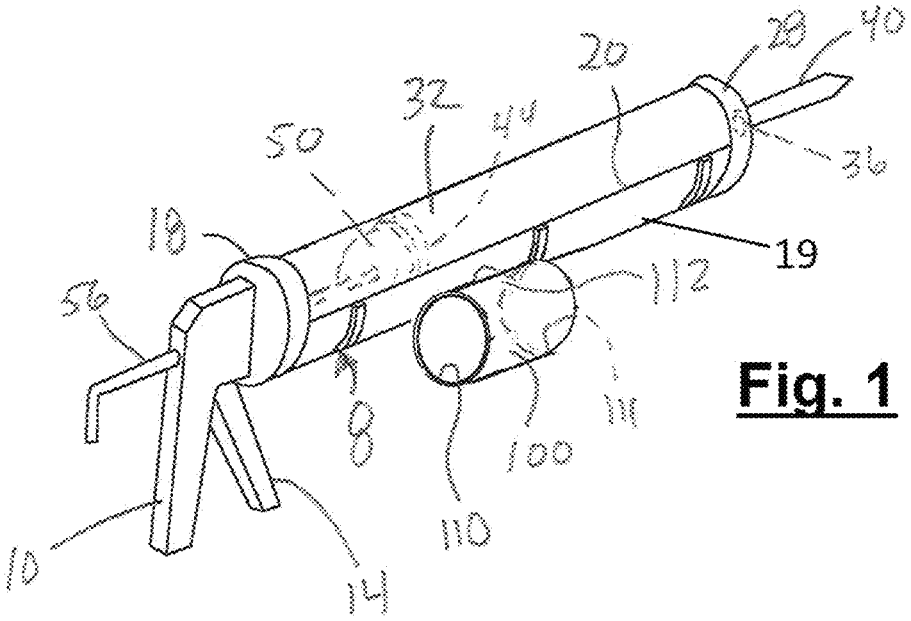
FIG. 1 is a perspective view of a caulk gun having an exemplary apparatus of the invention attached to the caulk gun.

FIG. 1 illustrates a conventional caulking gun 8 such as disclosed in U.S. Pat. No. 9,027,796 or 8,701,237, herein incorporated by reference. The gun includes a grip 10, a trigger 14 pivotally connected to a body 18. The body 18 includes a barrel 19 having a top or side opening 20 defined at one end by a front wall 28. The opening 20 allows for the installation of a disposable caulk cartridge 32 into the barrel 19. The front wall 28 includes an opening or slot 36 for receiving a nozzle 40 of the caulk cartridge. The caulk cartridge includes a movable rear wall 44. A piston 50 is fit into the body behind the rear wall 44. The piston is fixed to a rod 56 that has ratchet teeth (not shown) that are engaged to a toothed member (not shown) of the trigger 14. Pivoting of the trigger 14 pushes the piston forwardly against the movable end wall and within the caulk cartridge to force caulk though the nozzle 40. Rotation of the rod 56 can engage or disengage the trigger with the rod.

According to the exemplary embodiment of the invention shown in FIG. 1, an attached body 100 is connected to the caulk gun 8. The attached body comprises a tube 108 with an open end 110. An opposite end 111 can also be open. Alternatively, either one of the ends 110, 111 can be closed. The tube 108 can be attached to the caulk gun along an interface surface area 112 by adhesive, by welding, by molding together with the gun, or molding onto the gun, or can be attached to the gun 8 by a clip, a strap, a ratchet tie or zip tie, such as a nylon cable tie, surface fasteners, mechanical fasteners, and the like.

The attachment at the interface surface 112 can be made adjustable, fixed and/or removable.

Figure 3:
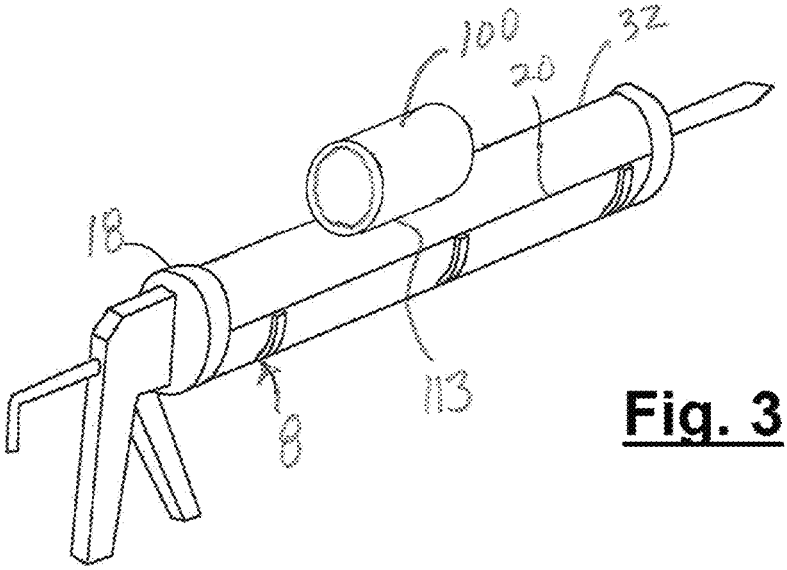
FIG. 3 is a perspective view of the caulk cartridge of FIG. 2 installed into a caulk gun.

According to another embodiment shown in FIGS. 2 and 3 the tube 108 can be attached to the disposable caulk cartridge 32. The attachment can be accomplished by adhesive along an interface surface 113 or by another type surface fastener, or by a strap, a ratchet tie or zip tie, such as a nylon cable tie, or other fastener, or welding, by molding the tube and the cartridge together, or can be attached to the cartridge 32 by clips, surface fasteners, mechanical fasteners, and the like.

The attachment at the interface surface 113 can be made adjustable, fixed and/or removable.

FIG. 2 also shows an optional feature wherein an insert or liner, in the form of a cup 114, can be fit into the open end 110 of the tube 108. The cup can have an open end 114*a* and a closed end 114*b* and a sidewall 114*c*. The sidewall 114*c* of the cup has an outside diameter to allow the cup 114 to be snugly, partially inserted into the open end 110 of the tube 108. The cup 114 can have a lip 114*d* around the open end 114*a* of the cup 114 that has an outside diameter 114*e* greater than the inside diameter 110*a* of the open end 110 of the tube 108 such that the cup is prevented from being pushed too deep into the tube and can be easily removed from the tube 108 by a user. The cup 114 can be a disposable article, such as composed of paper or plastic that once filled with caulk can be removed and discarded and a new cup 114 placed into the tube 108. The cup 114 can be used with all of the embodiments disclosed herein.

Figure 4:
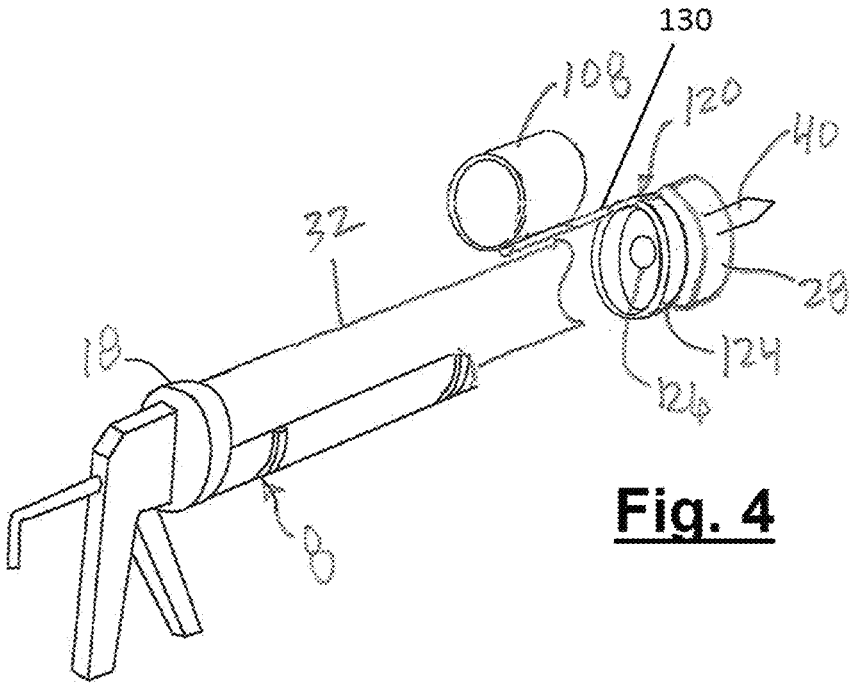
FIG. 4 is a fragmentary perspective view of a caulk gun with caulk cartridge installed into the gun and a further exemplary apparatus attached to the caulk cartridge.

According to FIG. 4, a bracket 120 attaches the tube 108 to the gun. The bracket includes a cap 124 which slips over a forward end of the cartridge 32. The cap includes an aperture 126 for receiving the nozzle 40. An extension 130 from the cap connects to the tube 108, positioning the tube 108 rearward of the cap 124. The cap is sized to fit at least partially within and/or against the end wall 28 of the gun 8. According to this embodiment the tube 108 can be removably attached to the cartridge and the gun without the use of adhesive or other fastening method.

Figure 5:
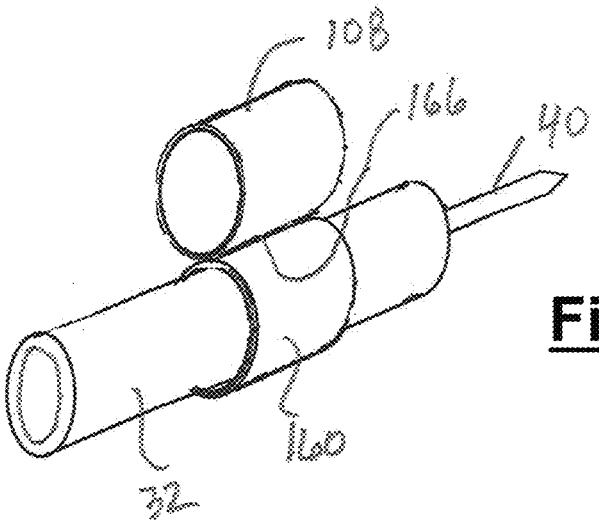
FIG. 5 is a perspective view of a caulk cartridge having an exemplary alternate apparatus of the invention attached to the caulk cartridge.
Figure 6:
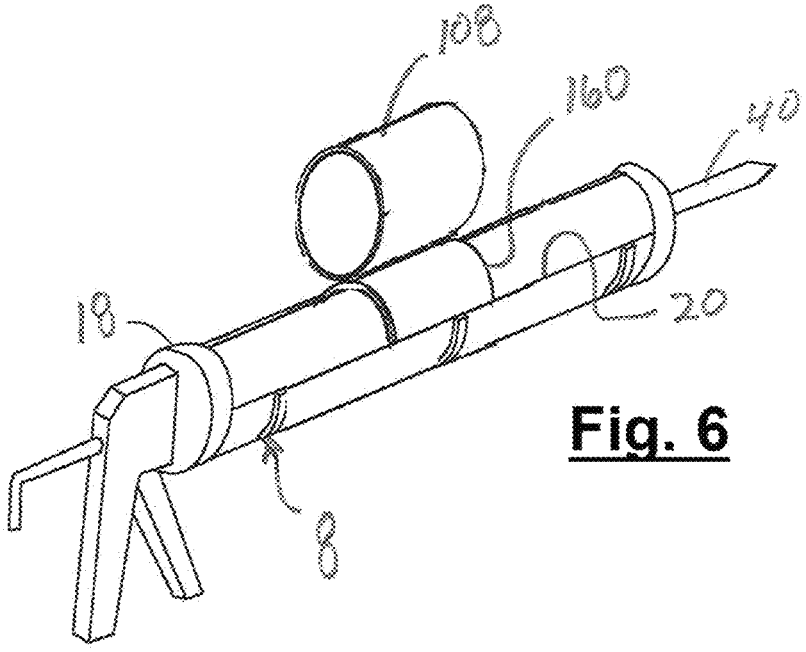
FIG. 6 is a perspective view showing the alternate apparatus of FIG. 5 attached to a caulk cartridge and installed into a caulk gun.
Figure 7:
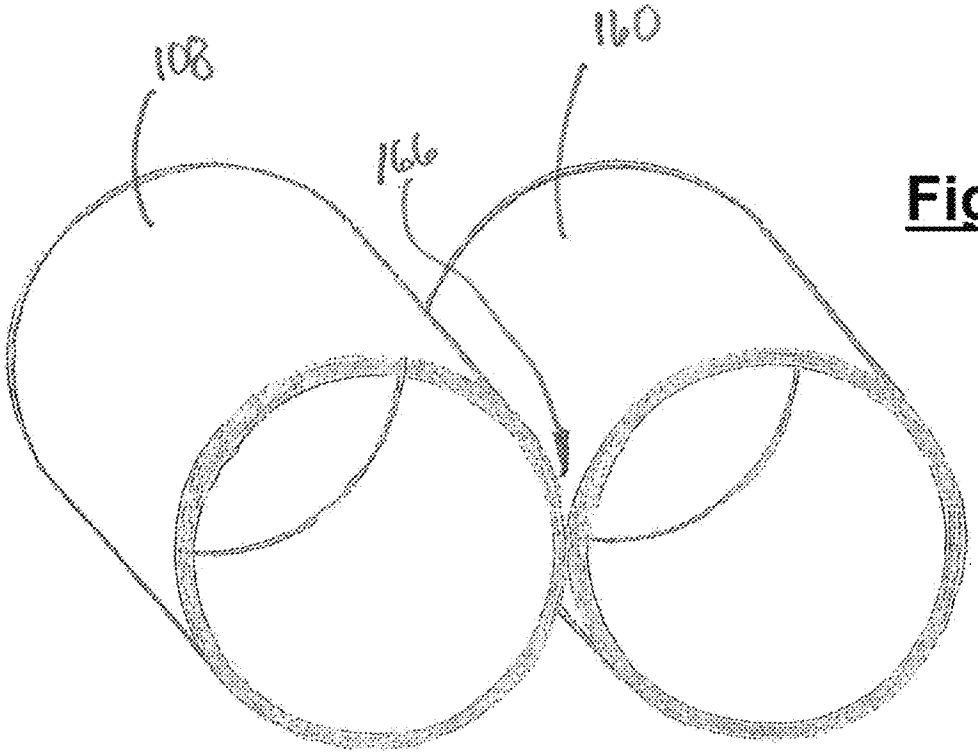
FIG. 7 is a perspective view of the alternate apparatus of FIGS. 5 and 6 separate from the caulk gun and cartridge.

According to FIGS. 5-7, the tube 108 is attached to the cartridge 32 by a slip-on sleeve 160 that is attached to the tube 108 by being molded with the tube 108 or adhesively secured to the tube 108 along an interface surface 166 or by other known means of attachment. The tube can be easily added to or removed from a cartridge 32 by sliding the sleeve 160 onto the cartridge and installing the cartridge into the gun 8. The sleeve makes the positioning of the tube 108 adjustable along the cartridge and rotationally about a centerline of the cartridge. The sleeve can have an inside diameter sized to snugly fit over the outside diameter of the cartridge such that the tube can be manually positioned on the cartridge and hold the position until moved to another position.

The attachment along an interface surface 166 between the tube and the sleeve can be accomplished by adhesive along the interface surface 166 or by another type surface fastener, or by a strap, a ratchet tie or zip tie, such as a nylon cable tie, or other fastener, or welding, by molding together with the sleeve, or can be attached to the sleeve 160 by clips, surface fasteners, mechanical fasteners, and the like.

The attachment at the interface surface 166 can be made adjustable, fixed and/or removable.

Alternative to a sleeve, a strap with an end connection can be used to attach the tube 108 either to the cartridge 32 or to the gun body 18.

Figure 8:
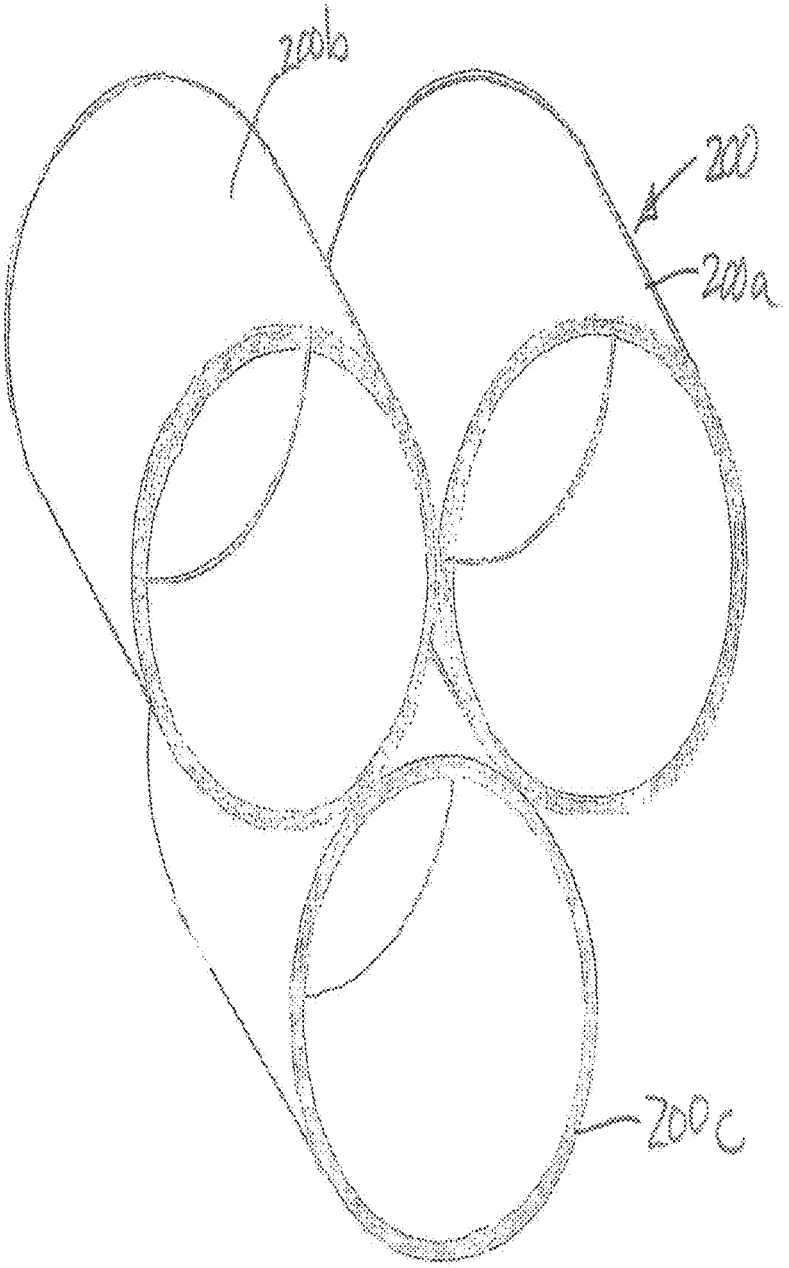
FIG. 8 is a perspective view of an exemplary further alternate apparatus of the invention.

FIG. 8 shows an alternate body 200 that includes multiple tubes 200*a*, 200*b*, 200*c*. The multiple tubes can be attached to the caulk cartridge or to the caulk gun in a manner described above. One of the tubes 200*a*, 200*b*, 200*c* can act as a sleeve 160 for sliding over the cartridge for holding the other two tubes outside the gun for use as a excess caulk receptacle.

The tube 108 can have a diameter greater than, equal to, or less than the diameter of the cartridge. The sleeve 160 can have an inside diameter slightly greater than the cartridge diameter to allow sliding and positioning of the sleeve on the cartridge. It is also possible that the sleeve has a cross section less than a full cylinder, such as having a cross section slightly greater than a semi-cylinder, wherein the sleeve clasps onto an outside of the cartridge rather than encircling the cartridge.

The tube 108 and the sleeve 160 can both have circular cross sections. The diameters of the tube and sleeve can be substantially identical. The tube 108 can have opposite open ends. In this way, the tube 108 and the sleeve 160 are interchangeable in function. A workman can pick up a loose attachment and use either cylinder as the tube and the other as the sleeve. This is advantageous because after some use, the wiping edge of the tube can become worn. A workman can simply remove the attachment from the cartridge 32 and re-install with the sleeve becoming the tube and the tube becoming the sleeve.

Figure 9:
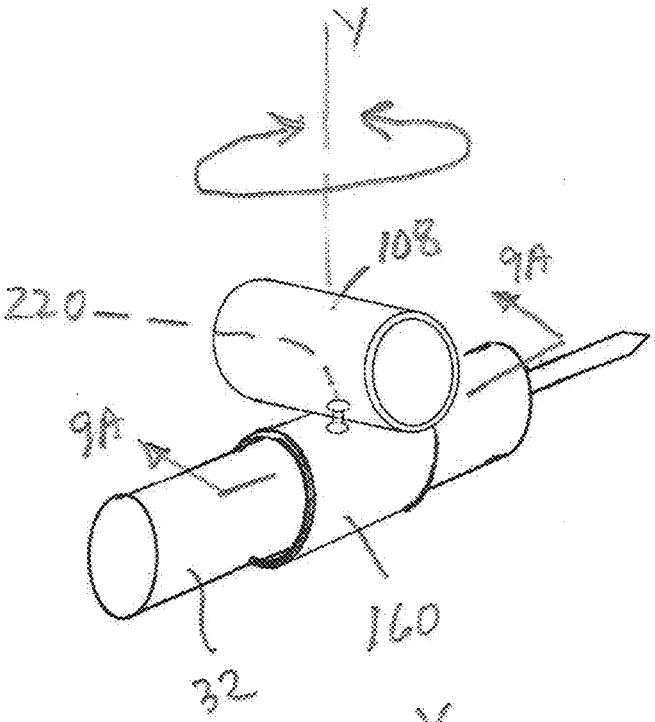
FIG. 9 is a perspective view of one way of attaching elements of the embodiment of FIG. 5.
Figure 9A:
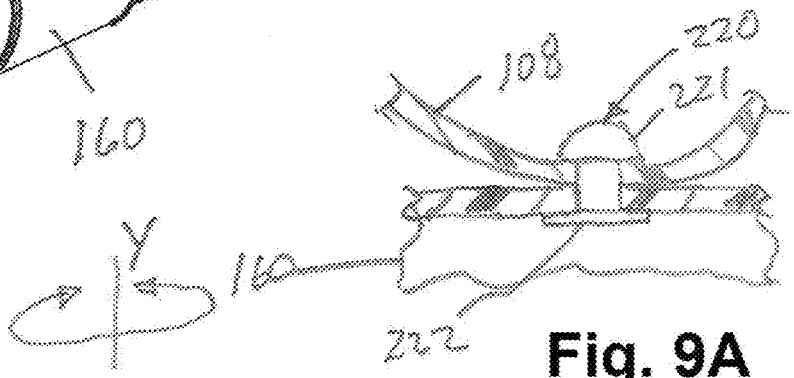
FIG. 9A is a fragmentary sectional view taken generally along line 9A-9A of FIG. 9.

FIGS. 9 and 9A illustrate one way of connecting the tube 108 to the sleeve 160 that surrounds the caulk cartridge 32. A fastener 220 such as a screw, bolt, rivet or the like pivotally connects the tube 108 to the sleeve 160. The fastener is shown visible in FIG. 9 for illustrative purposes. FIG. 9A shows the fastener 220 penetrates through the bottom wall of the tube 108 and the top wall of the sleeve 160 with heads 221, 222 or the like on both ends of the fastener to capture the walls of the tube 108 and the sleeve 160 between the heads. The fastener is loose enough to permit rotation, preferably of a sufficient tightness to retain the rotational position unless pushed by the user to rotate. The connection allows the tube to be selectively rotationally positioned about the illustrated axis Y according to the needs of the user or the required orientation of the caulk gun.

Figure 10:
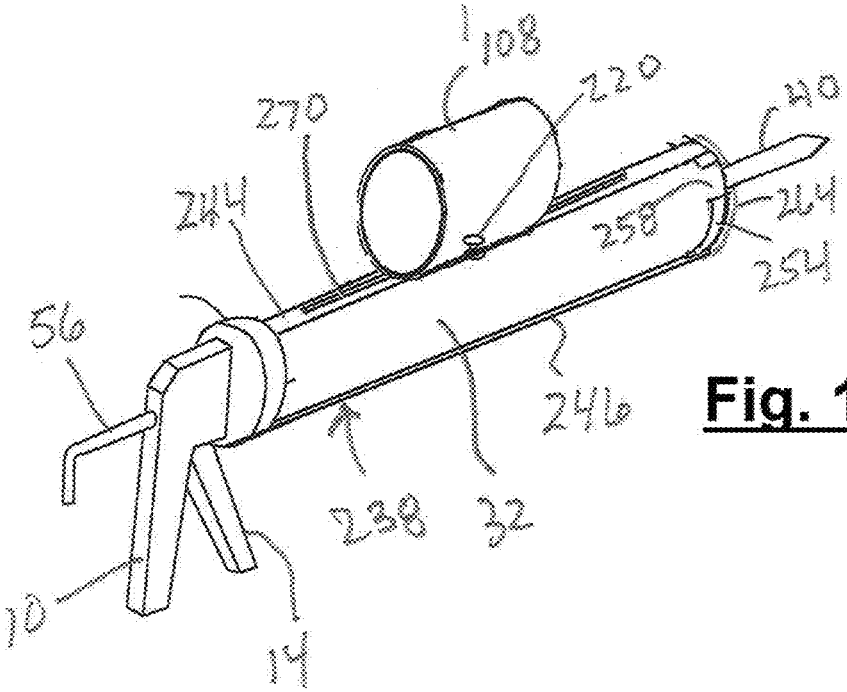
FIG. 10 is a perspective view of an alternate caulk gun with a caulk cartridge installed and exemplary apparatus of the invention attached to the caulk gun.

FIG. 10 illustrates an alternate caulk gun 238 of a type having an upper bar 244 and a lower bar 246 connecting a forward ring 254 having a break 258 to allow passing of the nozzle 40 into position in the gun 238. An annular retaining wall 264 is formed with or attached to the ring 254 to brace against a front end of the cartridge 32. In all other ways the gun functions the same as the previously described gun 8. In this embodiment the tube 108 is attached to the top bar 244 by the fastener 220. The top bar 244 can have a longitudinal slot 270. The fastener 220 penetrates through the bottom wall of the tube 108 and the top wall 244 with the heads 221, 222 or the like on both ends of the fastener to capture the walls of the tube 108 and the top wall 244 between the heads. The connection allows the tube to be selectively rotationally positioned about the illustrated axis Y according to the needs of the user or the required orientation of the caulk gun. The fastener 220 can penetrate through the slot 270. In this way the tube 108 has two degrees of freedom with respect to the gun 238: the freedom to rotate about the Y axis and the freedom to slide longitudinally along the slot 270. The fastener is loose enough to permit rotation and sliding, preferably of a sufficient tightness to retain the rotational and longitudinal position unless pushed by the user to rotate or slide. Alternative to a slot, the top wall 244 can simply have a hole for receiving the fastener 220 such that the tube would have only the rotational degree of freedom with respect to the gun 238.

The tubes 108, 200*a*, 200*b*, 200*c* and/or the sleeve 160 can be composed of metal, plastic, cardboard, or any material suitable for receiving excess caulk by a wiping action of the user's finger, or caulk wiped off a worker's caulk smoothing tool.

The tubes 108, 200*a*, 200*b*, 200*c* each can have one end open or both ends open.

The tubes 108, 200*a*, 200*b* can have a cross section other than a circular or annular cross section. For example, a square cross section tube can be used. Also, the tubes can have a cross section that is inconsistent along its length, such as the tube having an hourglass shape or a funnel shape.

The two style guns 8, 238 should be considered interchangeable in the embodiments as the described tubes 108, 200*a*, 200*b*, 200*c* and attachment methods can be easily adapted to work with either gun. There exists commercially two sizes of caulk cartridges and caulk guns and the above embodiments should be understood to encompass both sizes of cartridges and caulk guns.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A caulk wiping attachment for a caulk gun, the caulk gun having a barrel for holding a supply of caulk, comprising:

a tube having open opposite ends, and a sleeve attached to the tube, wherein the tube is attached to the caulk cartridge using the sleeve slipped over the caulk cartridge for coupling the tube to the barrel of the caulk gun in a position to be usable during operation of the caulk gun, the tube located externally of the barrel, and wherein the sleeve and the tube each have circular cross sections with substantially equal diameters, wherein the sleeve has an inner diameter greater than a diameter of the disposable caulk cartridge but less than an inner transverse dimension of the caulk gun barrel in order to fit therein.

2. The attachment according to claim 1, wherein the tube has an axial length less than an axial length of a cylindrical body of the caulk cartridge.

3. The attachment according to claim 2, wherein the tube has a length of about 1¾ inches.

4. The attachment according to claim 2, wherein the tube has a length of between ½ inches and 4 inches.

5. A caulk wiping attachment for a caulk gun, the caulk gun having a barrel for holding a supply of caulk, comprising:

a tube having at least one open end a means for coupling the tube to the barrel of the caulk gun in a position to be usable during operation of the caulk gun, the tube located externally of the of the barrel, further comprising one or more additional tubes arranged adjacent to the tube.

6. The attachment according to claim 5, wherein the means for coupling comprises the tube being attached to a disposable caulk cartridge installed into the barrel of the caulk gun, wherein the tube is adhesively secured to, or welded to, either the caulk gun or to the caulk cartridge.

7. The attachment according to claim 5, wherein the tube is removable and disposable.

8. An attachment for a tubular disposable caulk cartridge, comprising:

a cylindrical sleeve sized to be fit around an outside circumference of a cylindrical body of the caulk cartridge;

a tube arranged axially parallel to the sleeve and connected to the sleeve in a position to be usable during operation of the caulk cartridge fit into a caulk gun barrel of caulk gun, wherein the tube includes open opposite ends providing a wiping edge for wiping excess caulk from a user's finger or wiping tool, and wherein the sleeve and the tube each have circular cross sections with substantially equal diameters, wherein the sleeve has an inner diameter greater than a diameter of the disposable caulk cartridge but less than an inner transverse dimension of the caulk qun barrel in order to fit therein.

9. The attachment according to claim 8, wherein the tube and the sleeve have a substantially equal length, the equal length being less than 50% percent the length of the cylindrical body of the caulk cartridge.

* * * * *